United States Patent [19]

Thore

[11] 4,006,610

[45] Feb. 8, 1977

[54] METHOD AND APPARATUS FOR FEEDING PLURAL SLIVERS SELECTIVELY TO A HIGH PILE FABRIC KNITTING MACHINE

[75] Inventor: Thomas J. Thore, Tarboro, N.C.

[73] Assignee: Glenoit Mills, Inc., New York, N.Y.

[22] Filed: June 10, 1975

[21] Appl. No.: 585,473

[52] U.S. Cl. ..... 66/9 B; 19/145.7

[51] Int. Cl.[2] ..... D04B 9/14

[58] Field of Search ..... 66/9 B; 335/69; 19/105, 19/145.7

[56] References Cited

UNITED STATES PATENTS

| | | | |
|---|---|---|---|
| 1,894,596 | 1/1933 | Moore | 66/9 B |
| 2,880,600 | 4/1959 | Moore | 66/9 B |
| 2,964,932 | 12/1960 | Rose | 66/9 B |
| 3,248,902 | 5/1966 | Radtke | 66/9 B |
| 3,299,672 | 1/1967 | Schmidt | 66/9 B |
| 3,413,823 | 12/1968 | Beucus et al. | 66/9 B |
| 3,427,829 | 2/1969 | Wiesinger | 66/9 B |
| 3,465,269 | 9/1969 | Hendershot | 335/69 |
| 3,859,823 | 1/1975 | Ellis | 66/9 B |
| 3,911,696 | 10/1975 | Buckholtz et al. | 66/9 B |

*Primary Examiner*—Mervin Stein
*Assistant Examiner*—Andrew M. Falik
*Attorney, Agent, or Firm*—Robert B. Frailey

[57] ABSTRACT

Method and apparatus for feeding a plurality of separate slivers at a single sliver feeding station to the needles of a multi-feed high pile fabric knitting machine. The apparatus includes two or more separate assemblies of feed rolls for delivering sliver to the main cylinder of a sliver feeding device. Each assembly is provided with a separate timing control device for activating the feed rolls during selected time intervals to deliver sliver to the main cylinder to produce patterned high pile fabric. The timing control devices are operable to vary selectively the time intervals, both as to their duration and to the points in time when sliver delivery commences and ceases. The invention also contemplates a method of feeding a plurality of separate slivers at a single sliver feeding station to produce patterned knitted high pile fabrics having variable course-wise and wale-wise extending designs. Each individual sliver is fed selectively during plural time intervals of selected duration, to provide wale-wise extending, i.e. vertical designs in the fabric. The points in time when the sliver feeding time intervals commence and cease are selectively and continuously varied, to provide course-wise extending, i.e. horizontal design or patterning effects.

12 Claims, 10 Drawing Figures

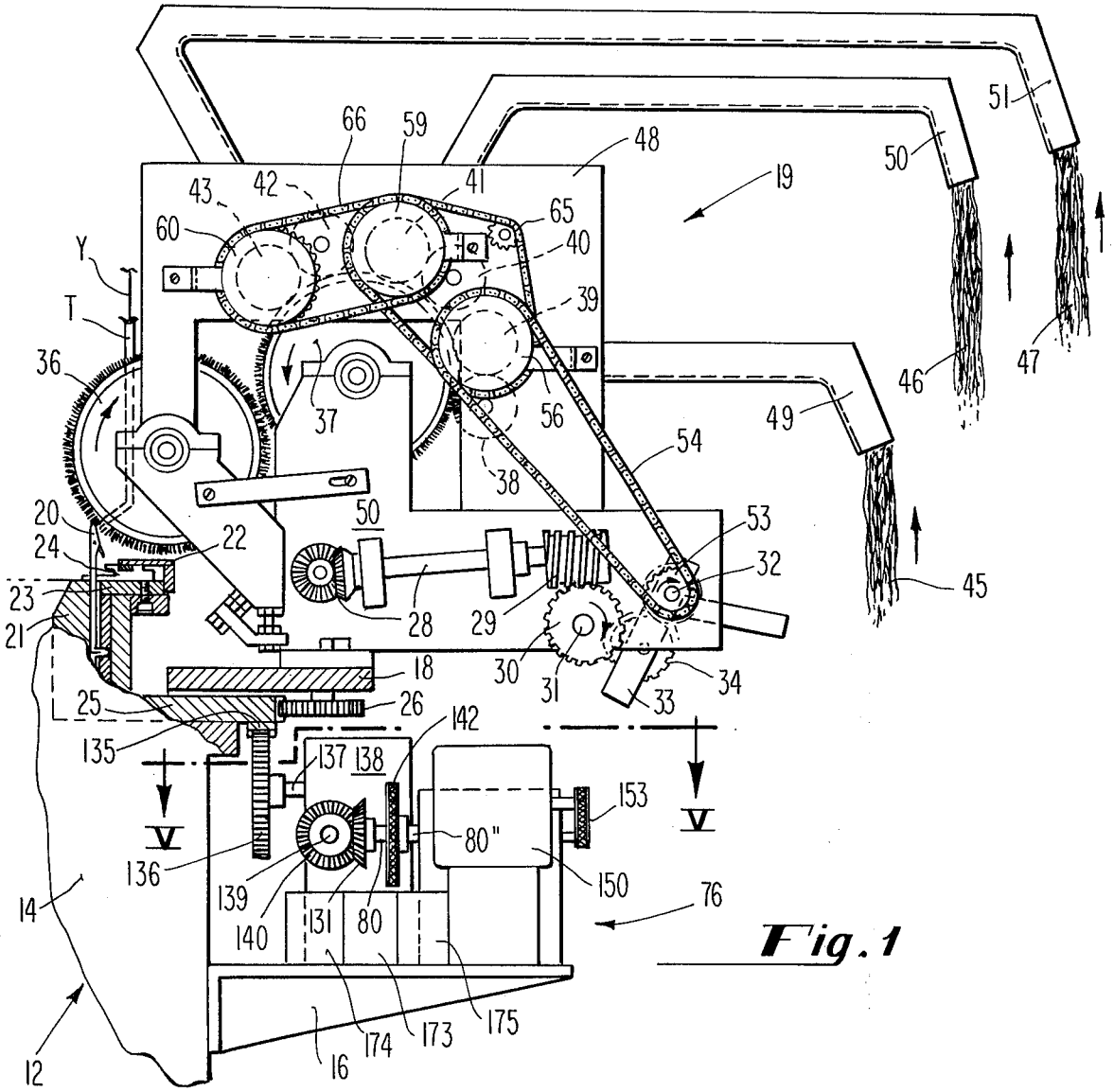
Fig. 1
Fig. 2
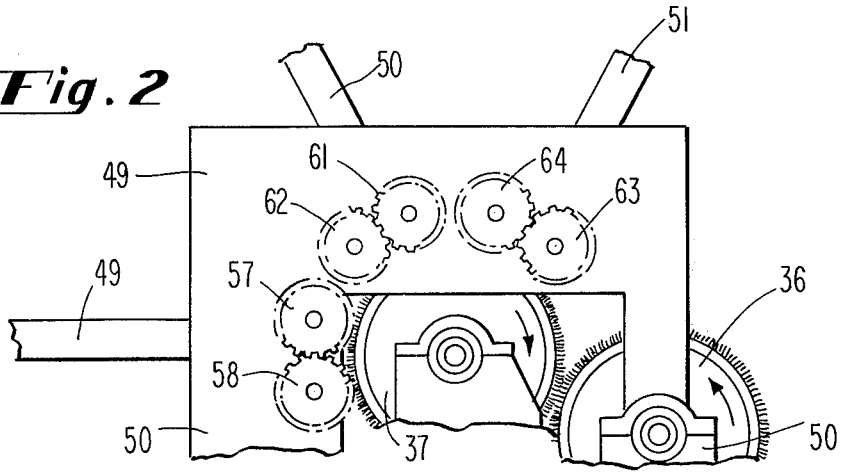

METHOD AND APPARATUS FOR FEEDING PLURAL SLIVERS SELECTIVELY TO A HIGH PILE FABRIC KNITTING MACHINE

BACKGROUND OF THE INVENTION

This invention relates to a sliver feeding device for high pile fabric circular knitting machines, designed to feed two or more separate rovings or slivers to the needles of the machine to produce patterned sliver knit high pile fabrics. Improved timing control means is provided for each separate sliver feed, to vary selectively the time interval during which each sliver is fed to the device, and also to vary selectively the points in time when feeding of each sliver commences and ceases during knitting of a fabric.

A great many patents have been granted directed to the knitting of patterned fabrics on sliver high pile fabric circular knitting machines. Among the U.S. Pat. Nos. directed to this subject are the following: 2,964,932, 3,010,297, 3,299,672, 3,413,823, 3,427,829, 3,709,002, 3,896,636, 3,896,637, and 3,918,273. These patents evince a steady progress in the improvement of, and extent of range of, designs in the knitting of patterned high pile fabrics. As a result of the improvements made in this art, it has become possible to knit fabrics having selectively variable pile densities, selected blends of pile fibers and various striped designs, extending either wale-wise (vertical) or course-wise (horizontal). The present invention is an improvement in the patterning techniques heretofore used in that it permits, for the first time, production of high pile fabrics having wale-wise extending or vertical designs having selectively variable zig-zag or staggered configurations extending course-wise or horizontally of the fabric.

SUMMARY OF THE INVENTION

A primary object of this invention is to provide a new and improved sliver feeding device for multi-feed high pile fabric circular knitting machines which has two or more separate assemblies of sliver feed rolls, for delivering selectively a plurality of different slivers of contrasting colors or weights to the main cylinder of the device, to produce patterned high pile fabrics of a wide variety of designs.

A further primary object of the invention is to provide a new and improved method of feeding a plurality of separate slivers of contrasting colors or weights to the needles of a high pile fabric knitting machine at a single feeding station, to produce patterned high pile fabric having variable course-wise and wale-wise extending designs.

A further object is to provide a new and improved multi-patterned sliver selection system for high pile fabric circular knitting machines which permits the knitting of a greatly expanded range of patterned high pile fabrics. Improved timing control is provided for each individual sliver of a plurality of slivers fed at a single sliver feeding station of the knitting machine. By reason of such improved sliver selection system, it is possible to program a selected sliver for incorporation into the fabric at any point around the needle cylinder of the knitting machine, and to program the duration or durations of time for feeding such sliver to the machine. It is possible, with this new and improved sliver selection system, to feed selectively any single sliver of a plurality of slivers, at a single sliver feeding station, any where from 0° to 360° around the needle circle, to provide a wide range of variable course-wise and wale-wise extending patterns.

To achieve the foregoing objectives, the invention, in its preferred form, comprises a sliver feeding device which incorporates the usual wire-covered doffer and main cylinder, a plurality of separate assemblies of sliver feed rolls for delivering slivers selectively to the main cylinder, electric clutches for each assembly of feed rolls, by which the feed rolls are activated for feeding sliver, and control means for activating the feed rolls during selected time intervals to produce patterned high pile fabric. The sliver feed control means includes a separate timing control device for each assembly of sliver feed rolls, which is connected to the feed roll clutch, and operable to vary selectively the duration of the time intervals of sliver feeding, and also for varying selectively and continuously the points in time for commencing and ceasing the time intervals during which sliver is fed. As a result of the inventive apparatus and method aforesaid, it is possible to incorporate sliver fibers of contrasting color and weight selectively throughout the courses and wales of the fabric, to produce a wide variety of multi-patterned sliver knit high pile fabrics.

DESCRIPTION OF THE VIEWS OF THE DRAWINGS

FIG. 1 is a fragmentary view in side elevation showing a preferred sliver feeding device embodying this invention.

FIG. 2 is a fragmentary view of the opposite side of the sliver feeding device shown in FIG. 1.

DETAILED DESCRIPTION OF THE INVENTION

Figure 3:
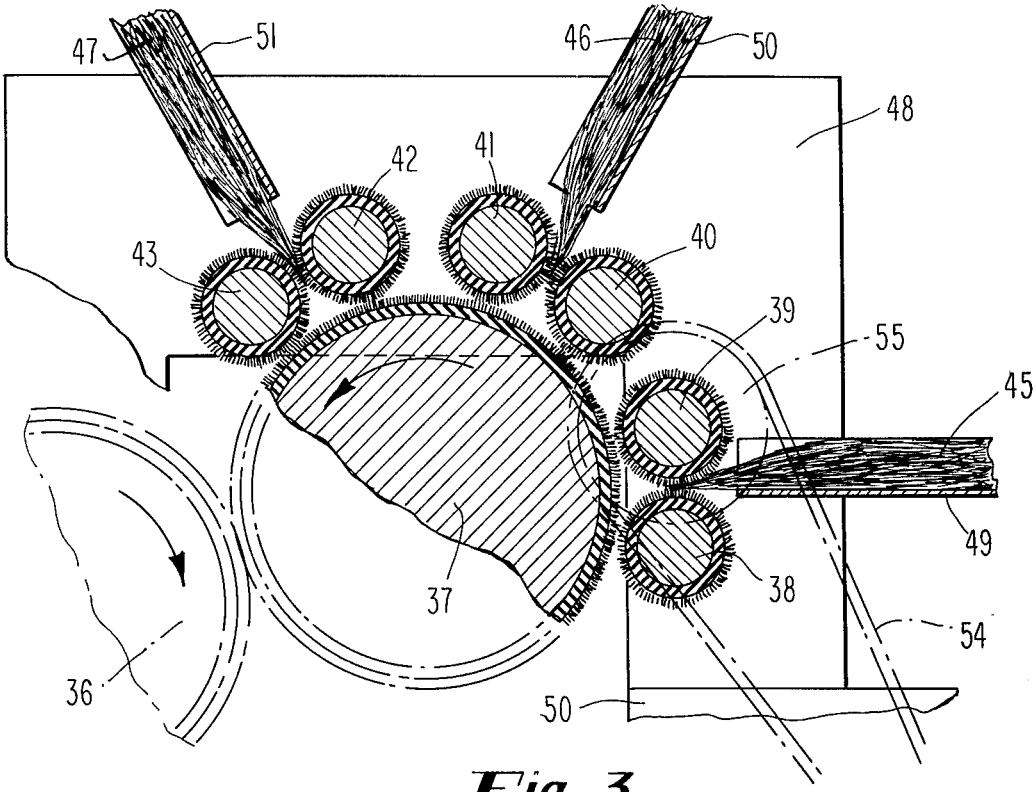
FIG. 3 is an enlarged fragmentary view in section of the sliver feeding device shown in FIG. 1.
Figure 4:
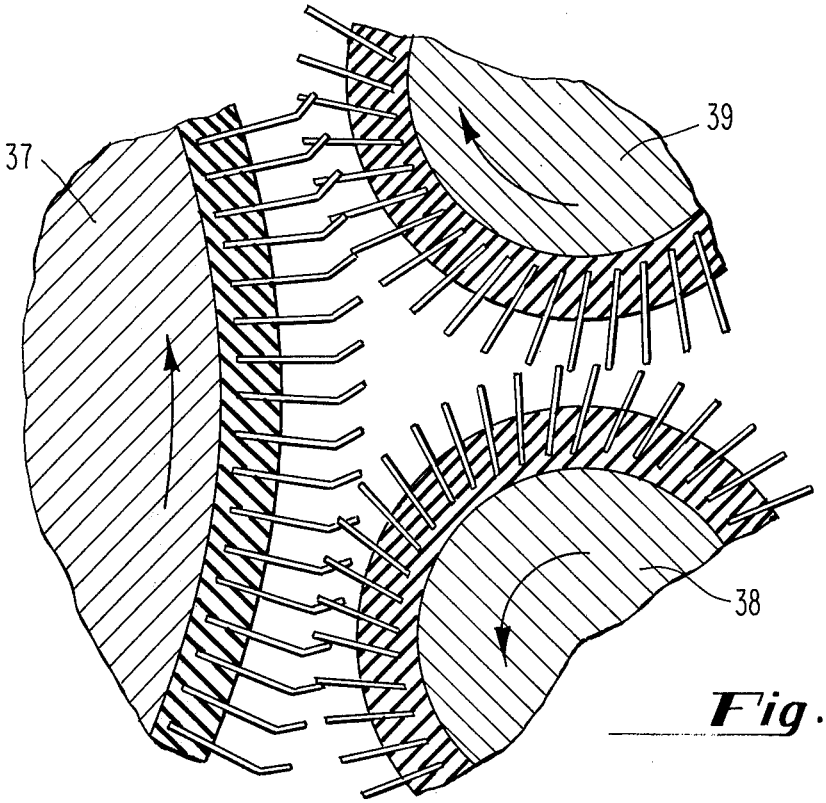
FIG. 4 is an enlarged, fragmentary view in section showing the meshing of the feed rolls and main cylinder of the sliver feeding means.

In FIG. 1 there is shown a sliver feeding device, located at a sliver feeding station of a multi-feed high pile fabric knitting machine, which incorporates a preferred embodiment of this invention. The sliver high pile fabric knitting machine is the usual well known type, illustrated in my U.S. Pat. Nos. 3,728,872, 3,896,636, 3,896,637 and 3,918,273.

More particularly, there is shown in FIG. 1 a knitting machine 12 having stationary frame 14, a sliver feeding device 19, a needle 20, rotatable needle cylinder 21, sinker cap 22, sinker ring 23, a sinker 24 and ring gear 25. The latter rotates with the needle cylinder and meshes with the pinion 26, to impart, through conventional and well known drive mechanism, rotative movement to the usual wire-covered doffer 36 and wire-covered main cylinder 37. The device 19 is supported on the stationary head ring 18 of the machine 12. Base yarn y is fed to the needles 20 via the usual yarn feed tube T.

In the embodiment shown, the sliver feeding device 19 incorporates (FIG. 3) three separate pairs or assemblies of wire-covered, arcuately spaced, sliver feed rolls 38 and 39, 40 and 41, 42 and 43, for delivering, respectively, rovings or slivers 45, 46, 47 to the main cylinder 37. The three assemblies of feed rolls draw their sliver 45, 46, 47 from sources (not shown) via chutes 49, 50, 51, respectively.

Each pair of feed rolls may be caused to rotate by ring gear 25 through a variable speed drive assembly like that illustrated and described in my U.S. Pat. Nos. 3,896,636 and 3,896,637 aforesaid. More particularly, the drive means for the feed rolls may include pinion 26, the usual shafting and gearing indicated generally by the reference numeral 28, worm 29, gear 30, shaft 31, a gear cone (not shown), shaft 32 and a gear selector indicated generally by the reference numeral 33. As explained in my U.S. Pat. Nos. 3,896,636 and 3,896,637, the gear selector 33 is slidable axially of shaft 32 to permit the selective engagement of its gear 34 with one of the gears of the gear cone, to vary selectively the speed of rotation of the sliver feed rolls.

The feed rolls 38, 39, 40, 41, 42 and 43, are journalled for rotation in horizontally spaced upright supports 48, 49, which comprise part of the stationary frame 50 of the sliver feeding device 19. The pairs of feed rolls 38 and 39, 40 and 41, 42 and 43, are driven, respectively, by magnetic or electric clutches 56, 59, 60. The driving arrangement for the arcuately spaced pairs of feed rolls preferably is of the type illustrated and described in my U.S. Pat. No. 3,918,273, aforesaid.

Thus, a sprocket wheel 53 is mounted on one end of shaft 32, and by means of a sprocket chain 54, drives sprocket wheel 55 (FIG. 3) affixed to the rotatable clutch element (not shown) of the magnetic clutch 56. The rotatable element of clutch 56 may be rotated at selected speeds, as determined by the gear cone (not shown) and gear selector 33, in the manner explained in my Pat. Nos. 3,896,636 and 3,896,637, to drive feed roll 39. When clutch 56 is energized, its rotational drive is imparted to sliver feed roll 39. By means of gears 57, 58 (FIG. 2), the rotational drive of feed roll 39 is imparted to feed roll 38, to rotate the feed rolls in unison and deliver the sliver or roving 45 to main cylinder 37, and thence to doffer 36 and the needles of the knitting machine 12.

The operation of feed rolls 40, 41 and of feed rolls 42, 43 is like that shown and described in respect to feed rolls 38, 39. Feed roll 41 is provided with the magnetic clutch 59, and feed roll 43 is provided with magnetic clutch 60. The rolls 40, 41 and 42, 43 are connected, respectively, by inter-meshing gearing 61, 62 and 63, 64 (FIG. 2). A second sprocket wheel (not shown) is affixed to the rotatable element (not shown) of clutch 56 and drives, by means of sprocket chain 65, a third sprocket wheel (not shown) affixed to clutch 59, to impart rotation thereto. By means of a similar construction, the rotatable element (not shown) of clutch 60 is driven from the unshown rotatable element of clutch 59 by chain 66. The construction and operation of clutches 59 and 60 is the same as that of clutch 56, whereby the pairs of feed rolls 40, 41 and 42, 43 are rotated selectively when their respective clutches are energized electrically, to deliver sliver to the main cylinder.

As will be explained, each clutch 56, 59, 60 is activated during selected time intervals, according to the dictates of a sliver feed control 76, to cause its feed rolls to deliver sliver selectively to the main cylinder 37, to produce patterned high pile knitted fabric. If desired, one only of the three separate, arcuately spaced, assemblies or pairs of sliver feed rolls 38 and 39, 40 and 41, 42 and 43, may be activated at any given time, to feed sliver or roving to the main cylinder 37, with the remaining assemblies of feed rolls being retained inactive. However, if desired, depending on the type of patterned fabric being knit, any two assemblies of feed rolls, or all three assemblies thereof, may be activated to feed their slivers or rovings simultaneously to the main cylinder 37.

The sliver feed control 76 for the sliver feeding device 19 is mounted on horizontal support bracket 16 affixed to the stationary frame 14 of the knitting machine 12. The sliver feed control 76, in the embodiment shown, includes three separate, spaced, clutch timing control devices 77, 77′, 77″, each constructed generally in accordance with the time variable cam-switches disclosed in R.V. Hendershot U.S. Pat. 3,465,269.

Figure 8:
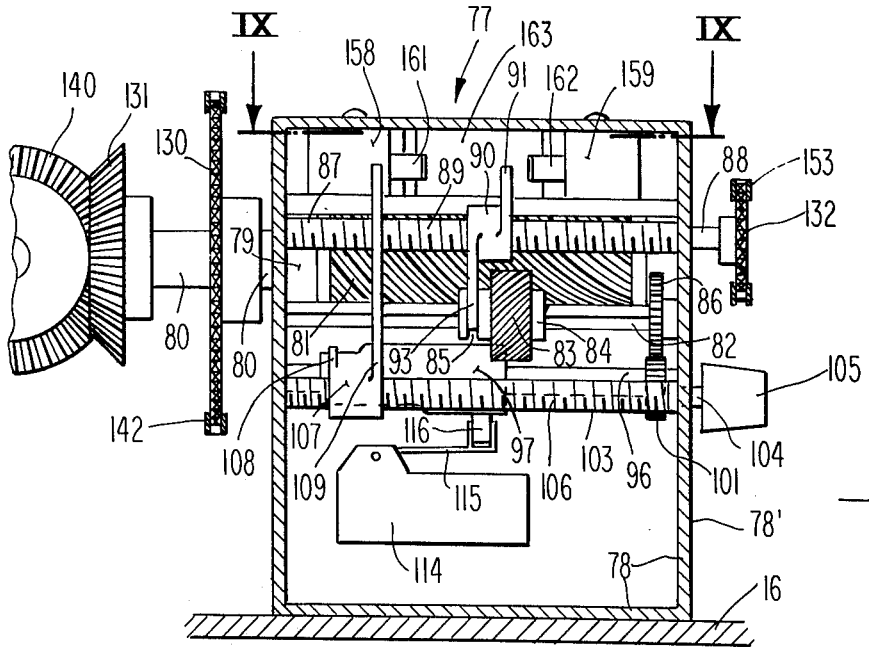
FIG. 8 is an enlarged, fragmentary view in section indicated by the arrows VIII—VIII of FIG. 5.
Figure 9:
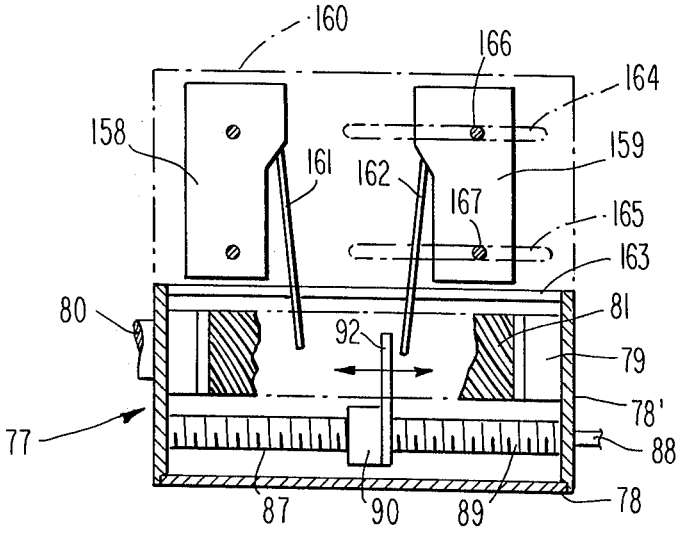
FIG. 9 is a fragmentary view in section indicated by the arrows IX—IX of FIG. 8.

Referring specifically to FIGS. 8 and 9, timing control device 77 includes a housing 78 which supports rotatably five parallel, horizontal, shafts 79, 82, 87, 96 and 103. Shaft 79 has a reduced shaft portion 80 extending rearwardly through and exteriorly of the housing 78. A sprocket wheel 130 is affixed to shaft extension 80, and a bevel gear 131 is secured to its distal end.

Internally of housing 78, shaft 79 mounts an elongated worm 81 which meshes with the worm gear 83 mounted slidably on shaft 82. Worm gear 83 is provided with an axially extending hub 84 having a circular slot 85 formed adjacent one end thereof.

The shaft 82 preferably is of hexagonal cross-section and mates with a correspondingly shaped co-axial passage extending through worm gear 83 and its hub 84. This arrangement enables worm gear 83 and its hub 84 both to drive rotatably and to slide axially along, shaft 82. A spur gear 86 is affixed to shaft 82 proximate the front wall 78′ of the housing 78, and rotates with that shaft.

Shaft 87 is provided internally of housing 78 with an external, elongated screw thread 89. It has a reduced shaft portion 88, which extends through and exteriorly of the front wall of the housing 78, and mounts a sprocket wheel 132. An internally threaded yoke 90 is threadingly engaged with screw thread 89 for axial movement along shaft 87 in response to the rotational movement thereof. Yoke 90 is provided with an upwardly inclined arm 91 (FIG. 8) which terminates in a horizontal finger 92 (FIG. 9) which, as will be explained, serves as a switch actuator. Yoke 90 also is provided with a downwardly depending bifurcated shifter arm 93, the spaced bifurcations of which engage the circular slot 85 of hub 84. The engagement of depending arm 93 with slot 85 causes yoke 90 to shift worm gear 83 slidably along its shaft 82 in response to axial movements of yoke 90 along its threaded shaft 87. Because of its meshing engagement with worm 81, the axial movement of worm gear 83 along its shaft 82 causes the worm gear to rotate, with consequent rotation of its shaft 82 and of the spur gear 86 affixed to that shaft.

Slidably mounted on shaft 96 is an elongated cylindrical cam 97 provided with raised and depressed timing cam areas of any selected configuration. Preferably, the raised portion of cam 97 is uniform in diameter and, if represented in a developed plane, is triangular in shape. Cam 97 may be similar in configuration to the cam illustrated in U.S. Pat. No. 3,465,269, aforesaid. Preferably, cam shaft 96 is of hexagonal cross-section and engages slidably within a corresponding, co-axial, hexagonal passage formed internally of cam 97. Thus, cam 97 both rotates with, and is slidable axially of, its shaft 96. A spur gear 101 is affixed to cam shaft 96, and meshes with spur gear 86 on shaft 82. The gears 86, 101 have a ratio of 1:1, whereby each full rotation of shaft 82 imparts a full reverse rotation to cam shaft 96. Similarly, any angular movement or displacement of shaft 82 imparts, through gears 86, 101, a corresponding reverse angular movement or displacement to cam shaft 96.

Shaft 103 is substantially identical to shaft 87, and is provided with an exterior screw thread 106. It also has a reduced shaft extension 104 which passes through and extends beyond the front wall of the housing 78. A control knob 105 is mounted on the distal end of shaft extension 104.

An interiorly threaded yoke 107 engages the exterior screw thread 106 of shaft 103, with capacity for threading movement axially along that shaft. By means of control knob 105, shaft 103 may be rotated manually to shift yoke 107 axially of that shaft.

Yoke 107 is provided with a transversely extending, upwardly inclined, bifurcated arm 108 which engages a slot (not shown) formed in timing cam 97. By this arrangement, axial movement imparted to yoke 107, by the manual rotation of shaft 103, causes cam 97 to be shifted axially along its shaft 96. Yoke 107 also is provided with a upwardly extending vertical arm 109 which terminates in a horizontal pointer or scale indicator (not shown), by which the accurate, selective axial adjustment or setting of cam 97 relative to its shaft 96 may be achieved.

The raised portion of cam 97 is designed to engage and depress the cam follower roller 116 disposed on the distal end of an upwardly biased, pivotal actuator arm 115 of an electric switch 114, to close the switch. The switch 114 is fixed within housing 78 and is connected electrically, by suitable circuitry (FIG. 10), to magnetic clutch 56 associated with the feed rolls 38, 39. When the raised portion of cam 97 engages roller 116 to close switch 114, the clutch 56 is energized to cause feed rolls 38, 39 to rotate to deliver roving 45 to the main cylinder 37. The duration of the time interval during which the rolls 38, 39 feed roving 45 is determined by the axial setting of cam 97 on its shaft 96, relative to cam roller 116, resulting from manual adjustment of shaft 103.

The point in time when cam 97 closes switch 114 to energize electric clutch 56, and then disengages from switch 114 to de-energize the clutch, depend on the angular setting of cam 97 and its shaft 96 relative to cam follower roller 116, as explained in Patent 3,465,269 aforesaid.

Thus, clutch control device 77 serves as a cam-switch to control selectively the energization and de-energization of magnetic clutch 56, to thereby cause feed rolls 38, 39 to feed the roving or sliver 45 selectively, during selected time intervals, to produce patterned sliver knit high pile fabric. Rotation of shaft 80, 79 and its worm 81 imparts rotation to gears 83, 86, 101 to drive the cam shaft 96 and impart rotation to its timing cam 97, to close switch 114 for the time intervals selected. The duration of any selected time interval depends on the axial setting of rotatable cam 97 relative to its shaft 96. The points in time when the selected time interval commences and ceases are determined by the angular setting of rotatable cam 97 relative to the cam follower roller 116 of switch 114.

The angular setting of cam 97 may be selected by two different methods. First, it may be accomplished by the selective angular setting of worm shaft 79 which, via worm 81, worm gear 83, shaft 82, gear 86 and gear 101, imparts a corresponding angular displacement to shaft 96, and hence to the cam 97. Alternatively, a selected angular setting of threaded shaft 87 will displace yoke 90 and worm gear 83 axially relative to their respective shafts, causing angular displacement of the worm gear 83 and its shaft 82. This latter angular movement is transmitted to cam 97 via shaft 82, gears 86 and 101 and cam shaft 96.

Figure 5:
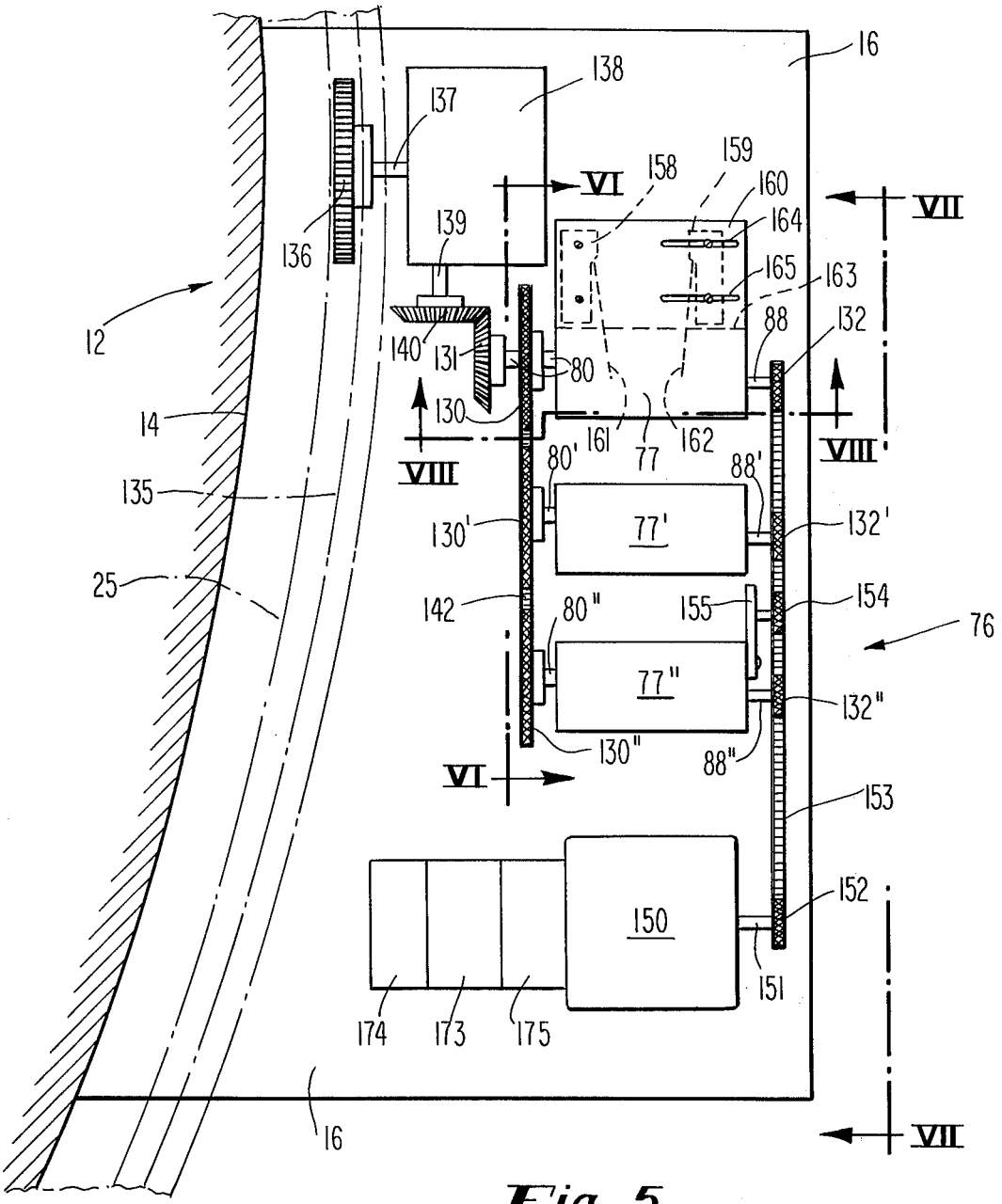
FIG. 5 is an enlarged, fragmentary view in section indicated by the arrows V—V of FIG. 1.
Figure 6:
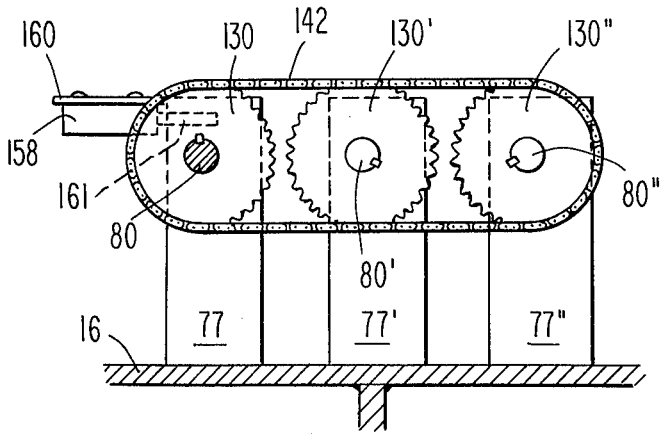
FIG. 6 is a fragmentary view in elevation looking in the direction of the arrows VI—VI of FIG. 5.
Figure 7:
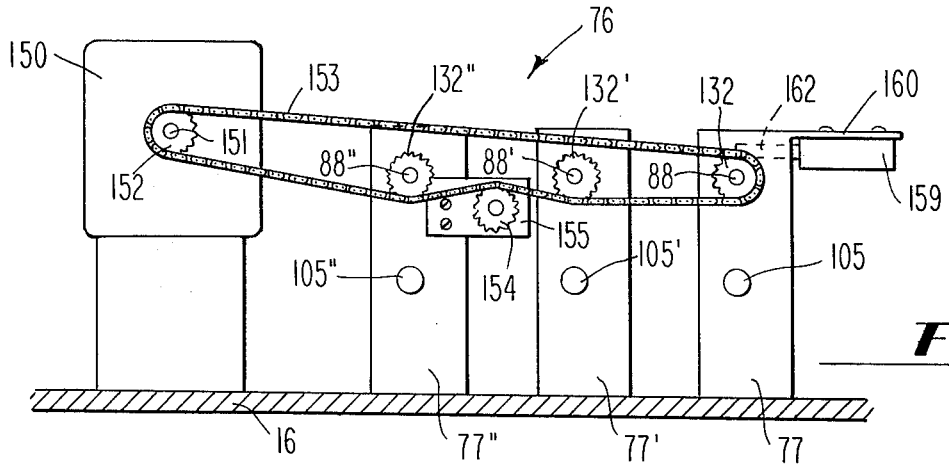
FIG. 7 is a fragmentary view in elevation looking in the direction of the arrows VII—VII of FIG. 5.

Similarly, clutch control devices 77' and 77'' serve as cam-switches to control selectively the energization and de-energization, respectively, of the magnetic clutches 59, 60. Accordingly, the pairs of feed rolls 40, 41 and 42, 43 each are operable during selected time intervals, to feed their slivers 46, 47 to produce patterned pile fabric. As illustrated in FIGS. 5, 6, 7, clutch control device 77' includes exterior shaft extension 80' having sprocket wheel 130' affixed thereto, and exterior shaft extension 88' having sprocket wheel 132' affixed thereto. In the same manner, clutch control device 77'' is provided with shaft extensions 80'', 88'' and sprocket wheels 130'', 132''. Clutch control devices 77' and 77'' also include cam control knobs 105' and 105'', which correspond in structure and function to the cam control knob 105 of device 77.

The sliver feed control 76, as best shown in FIGS. 1 and 5, is driven from the ring gear 25 of the knitting machine 12. More particularly, ring gear 25 is provided on its underside, adjacent its rim, with an annular gear 135 having downwardly depending teeth which mesh with spur gear 136 affixed to horizontal shaft 137 extending from a gear reducer 138. A second horizontal shaft 139, having its axis transverse to the axis of shaft 137, extends outwardly of gear reducer 138, and has bevel gear 140 affixed to its distal end. Bevel gear 140 meshes with the bevel gear 131 on shaft extension 80, to impart continuous rotation to worm shaft 79 and its sprocket wheel 130 and worm 81.

Preferably, the speed ratio of annular gear 135, and hence of the needle cylinder 21, to worm shaft 79 is 1:1. This may be accomplished, for example, by providing annular gear 135 with 300 teeth, providing spur gear 136 with 30 teeth and utilizing a gear reducer 138 having a gear ratio of 1:10.

A sprocket chain 142 (FIG. 6) is entrained about sprocket wheels 130, 130', 130'', whereby sprocket wheel 130 drives sprocket wheels 130' and 130'' to impart continuous rotation to their respective worm shafts via shaft extensions 80' and 80''. Thus, all three worms of the three timing control devices 77, 77', 77'' are driven from the ring gear 25 at a speed ratio of 1:1 relative to the needle cylinder 21.

Referring now to FIGS. 5 and 7, it will be observed that the sliver feed control 76 includes a reversible motor 150 having an outwardly extending shaft 151, to which is affixed a sprocket wheel 152. A sprocket chain 153 engages sprocket wheels 152, 132'', 132' and 132, whereby reversible motor 150 drives rotatable shaft extensions 88'', 88', 88 and the respective threaded shafts (e.g. shaft 87) of which they are an extension. This sprocket wheel drive system also includes an idler sprocket wheel 154 engageable with sprocket chain 153, and mounted rotatably on a bracket 155 affixed to control device 77''.

Reversible motor 150 is controlled by a pair of spaced switches 158, 159 secured to the underside of a horizontal extension or platform 160 extending laterally from the top of housing 78 of clutch timing control device 77 (FIGS. 5, 7 and 9). The switches 158, 159 include, respectively, pivotal actuator arms 161, 162 which extend through lateral opening 163 in housing 78, and terminate within the housing, above the shafts therein, at locations which overlap the distal end of horizontal finger 92 (FIG. 9). Finger 92 functions as a switch actuator for the switches 158, 159 which, in turn, determine the direction of rotation of reversible motor 150. As yoke 90 travels axially back and forth on threaded shaft 87, its finger 92 contacts the arms 161, 162 of the switches 158, 159 to close and actuate those switches.

When reversible motor 150 causes sprocket wheel 152 to rotate clockwise, chain 153 causes sprocket wheel 132 and threaded shaft 87 likewise to rotate in the clockwise direction, with the result that yoke 90 and its switch actuator 92 move axially to the right, as viewed in FIGS. 8 and 9. Such axial movement of yoke 90 continues in the same direction until its actuator finger 92 strikes switch arm 162 to close switch 159. The closing of switch 159 reverses the circuit to motor 150, causing it to reverse its direction of rotation, whereby its shaft 151 and sprocket wheel 152 are caused to rotate in the counter-clockwise direction, as seen in FIG. 7. This reversal in the direction of rotation of motor 150, of course, reverses the direction of travel of chain 153, causing threaded shaft 87 to likewise rotate counter-clockwise, with consequent reversal of the direction of travel of yoke 90 and its actuator finger 92, so they move axially leftward, as viewed in FIGS. 8 and 9. Such leftward travel of yoke 90 and finger 92 continues until finger 92 strikes switch arm 161, to close switch 158 and again reverse the circuit to motor 150, whereupon the motor again reverses its direction of rotation to cause sprocket wheels 152 and 132 to rotate clockwise, thereby reversing the direction of travel of yoke 90 and its actuator finger 92. Thus, with the arrangement shown, motor 150 and its control switches 158, 159 cause finger 92 to reciprocate axially within the limits of the spacing between the switch actuator arms 161, 162.

Such reciprocal movement of yoke 90 is transmitted, via shifter arm 93 and slot 85 to the rotating worm gear 83, causing the latter also to reciprocate axially of its shaft 82. As worm gear 83 reciprocates, it is displaced or shifted angularly by reason of its engagement with and axial movement relative to worm 81. Such angular movement is transmitted to rotating cam 97 via shaft 82, gears 86, 101 and cam shaft 96. The result of the angular displacement of cam 97 is to vary the points in time when the cam 97 engages with, and disengages from, switch 114, to thereby vary the points in time when switch 114 energizes and de-energizes its clutch 56. As a result, the points in time when feed rolls 38, 39 commence feeding sliver 45, and cease feeding their sliver, similarly are varied.

Since each reciprocal stroke of yoke 90 is a continuous movement from the start to the end of the stroke, the corresponding angular displacements of the rotating worm gear 83 and cam 97 also occur continuously. As a result, the points in time when switch 114 energizes and de-energizes clutch 56, and when feed rolls 38, 39 commence and cease feeding their sliver 45, also are changed continuously.

Timing control devices 77' and 77'' are provided with threaded shafts, yokes, worms, etc., similar to the parts of device 77, all of which are operated in like manner, with identical functions, as a result of the drive of motor 150 via chain 153 to sprocket wheels 132', 132'', respectively. Thus, rotatable cam-switches 97', 114' and 97'', 114'' (FIG. 10) control selectively the energization of clutches 59, 60, and the rotation of their respective feed rolls, in the same manner that rotatable cam-switch 97, 114 controls the energization of clutch 56 and the rotation of its feed rolls 38, 39.

Switch 158 may be affixed permanently to platform 160, whereas switch 159 may be mounted adjustably with respect to the platform, to vary selectively the spacing between the switches and their respective actuator arms 161, 162. For this purpose, spaced, elongated, parallel slots 164, 165 are formed in plate 160, for the slidable reception of spaced pins 166, 167 affixed to switch 159 and provided with enlarged head portions. By reason of the slots and pins, switch 159 may be affixed to plate 160 at selected spaced distances from switch 158, thereby varying selectively the spacing between switch arms 161, 162. By reason of such adjustment of the two switch arms relative to each other, the axial distance of travel of yoke 90 and worm gear 83, and the range of angular displacement of rotatable cam 97, may be selectively varied. As will be readily understood, the spacing between switch arms 161, 162 will likewise vary and control the movements and angular displacement of the comparable parts of clutch control devices 77' and 77''.

Figure 10:
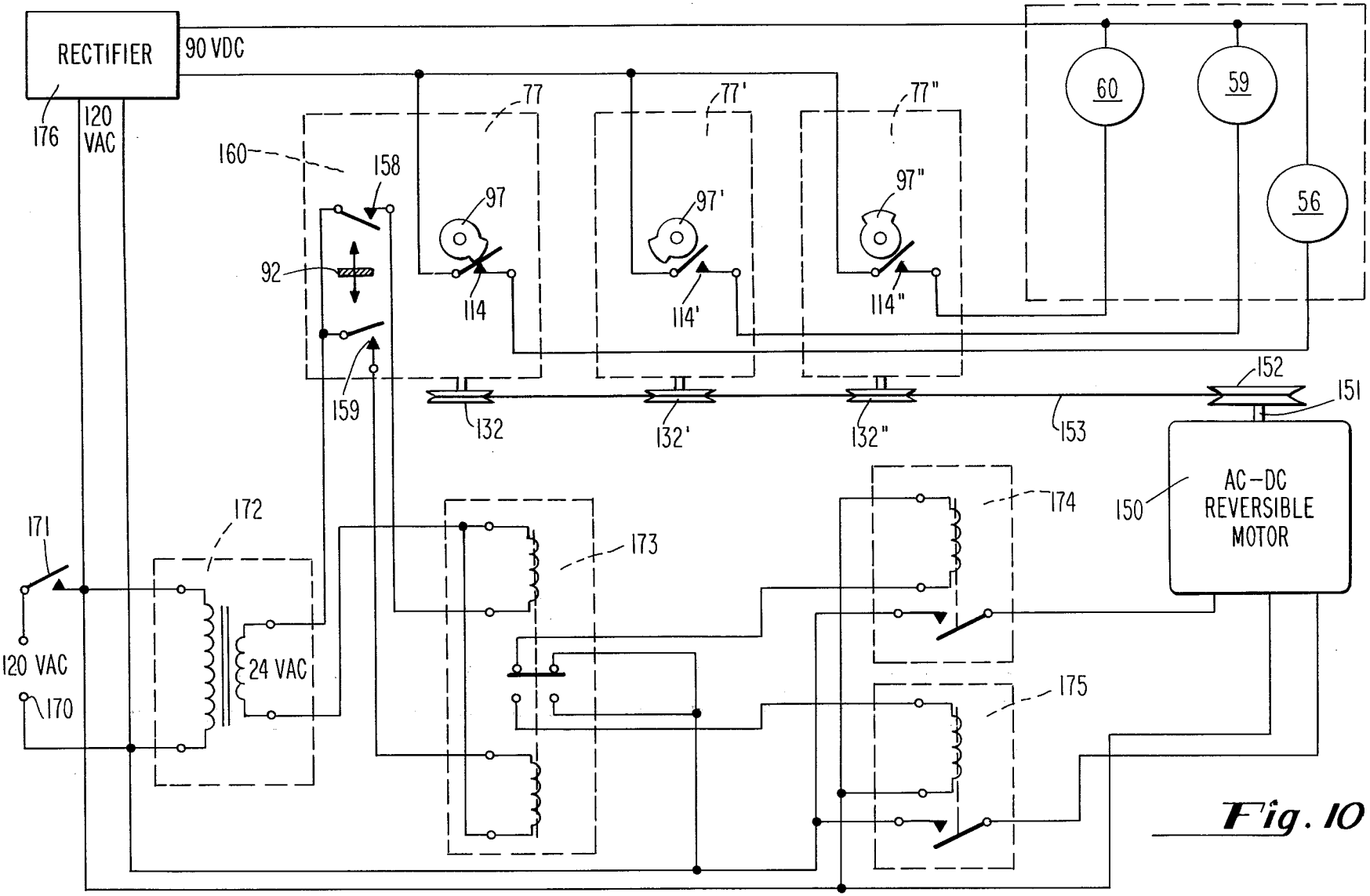
FIG. 10 is a schematic wiring diagram illustrating a preferred control system for the sliver feeding device.

A preferred electrical system for the control of sliver feed roll clutches 56, 59, 60 is illustrated in FIG. 10. The electrical circuitry includes a voltage source 170, starting switch 171, transformer 172, a double-throw latching relay 173, and a pair of time delay relays 174, 175. As illustrated, switch 159, via latching relay 173, controls time delay relay 175, to cause motor 150 to rotate in a counterclockwise direction. Switch 158, via latching relay 173, controls time delay relay 174, to cause motor 150 to rotate in a clockwise direction. The sub-circuit which includes the clutches and the clutch control devices may be provided with a rectifier 176, which connects the sub-circuit to the voltage source 170.

If desired, the sliver feed control device 76 may be employed without the utilization of motor 150 and its sprocket chain drive to threaded cam adjuster shaft 87 and the comparable shafts of timing control devices 77', 77''. In such event, the angular settings or adjustments of rotatable cams 97, 97', 97'' are selected by manual adjustment of threaded shaft 87 and its corresponding threaded shafts. The elimination or inactivation of motor 150 results in the knitting of high pile fabrics where the wale-wise extending or vertical design characteristics are invariable throughout the fabric, e.g., plain fabric of a single color and weight, or ombre fabric of uniformly blended sliver fibers throughout, or fabric having vertical stripes.

For example, if the three worm shafts corresponding to shaft 79 (FIGS. 5, 8) are set at angular intervals of 120° apart with respect to each other, and if their corresponding cams 97, 97', 97'' are adjusted axially to close their respective switches during successive 120° intervals, the three pairs of feed rolls 38 and 39, 40 and 41, 42 and 43 feed their respective slivers 45, 46, 47 successively, during successive 120° arcs of the needle cylinder or circle. This provides a fabric having three vertical stripes of equal width composed of the fibers of slivers 45, 46, 47. By slight axial adjustment of the cams 97, 97′, 97″, by turning of their respective knobs 105, 105′, 105″, it is possible to increase or decrease the cam dwell periods, during which their raised portions maintain the switches 114, 114′, 114″ closed, to feed the slivers 45, 46, 47. Thus, with respect to the feeding of any two successive slivers, a slight overlap in feeding times may be provided, or a gap between the feeding times or intervals may be provided, as described.

By selective adjustment of the axial positions of the timing cams by means of their control knobs, or of their angular settings by manual adjustment of the threaded shafts corresponding to shaft 87, feeding of the slivers 45, 46, 47 may be adjusted selectively through a wide range of patterning, to permit any two, or all three, slivers to be delivered simultaneously to the main cylinder 37, or for their feeding intervals to overlap to any desired degree, to produce selected fiber blending and/or variable fiber density in the fabric.

While in FIG. 6 the three worm shafts are illustrated as being displaced 120° angularly out of phase with each other, it will be understood that the arrangement shown is for purposes of illustration only. The anuglar setting of the worm shafts corresponding to shaft 79 is a matter of choice, and their respective settings may be varied without limitation to produce a wide variety of fabric patterns.

It also is to be understood that the sliver feeding device 19 may be provided with less than, or more than, three separate assemblies of sliver feed rolls, each provided with its own separate timing control device corresponding to device 77.

The utilization of the reversible motor 150, and its reversible drive system, as explained, adds to the time-controlled sliver feeding system of this invention the further steps of advancing the points in time when the time intervals of sliver feeding commence or cease, and retarding the points in time when the time intervals of sliver feeding commence and cease. In the preferred embodiment shown, these additional steps alternate in the knitting of the fabric, to thereby provide wale-wise extending or vertical fabric designs having variable course-wise extending or horizontal pattern effects, such as vertical stripes having a zig-zag or staggered configuration. Thus, by varying selectively and continuously the points in time for commencing and ceasing the time intervals during which the sliver feed rolls 38, 39, 40, 41, 42, 43 deliver their slivers 45, 46, 47, to the main cylinder 37, and by selectively advancing and retarding those points in time, the fibers of the multiple slivers may be incorporated into selected wales and selected courses of fabric to provide a wide range of new pattern effects in sliver knit high pile fabrics.

Although a preferred embodiment of this invention has been shown and described for the purpose of illustration, as required by title 35 U.S.C. 112, it is to be understood that various changes and modifications may be made therein without the departing from the spirit and utility of this invention, or the scope thereof as set forth in the appended claims.

I claim:

1. In a sliver feeding device for a high pile fabric circular knitting machine, said device having a main cylinder, plural assemblies of rotatable sliver feed rolls spaced arcuately about the cylinder, sliver feed control means for activating the feed rolls during selected time intervals to deliver sliver selectively to the cylinder, said control means including a separate timing control device and a separate drive means associated with each assembly of feed rolls for rotating selectively the feed rolls to deliver sliver to the cylinder, each said drive means being connected electrically to the timing control device for its feed rolls, the improvement wherein each separate timing control device includes:

a. a cam-switch assembly connected electrically to the drive means, said cam-switch assembly including a rotatable timing cam for actuating the switch selectively, b. drive means to rotate the timing cam continuously and c. control means for the timing cam to adjust the cam position continuously as the cam rotates relative to its switch, to vary selectively the points in time when the time intervals commence and cease, and the duration of the time intervals, during which the feed rolls deliver sliver to the cylinder.

2. The sliver feeding device of claim 1, wherein a. the rotatable cam is of generally cylindrical formation, and is provided with raised and depressed areas, b. the switch is provided with an actuator arm adapted to be contacted by a raised area of the cam and c. the control means for the cam for adjusting the cam relative to the switch comprises means for adjusting the rotatable cam angularly about its axis.

3. The sliver feeding device of claim 2, wherein the cam control means includes a. a reversible electric motor for imparting angular displacement to the cam, b. a pair of switches for controlling the direction of rotation of the motor and c. switch actuating means, driven by the motor, operable to actuate the switches to reverse periodically the direction of rotation of the motor.

4. A method of producing patterned sliver knit high pile fabric having selectively variable course-wise and wale-wise extending designs, comprising the steps of a. selectively feeding at a single sliver feeding station a plurality of separate slivers to the needles of a knitting machine for incorporation selectively into a fabric to provide a patterned high pile fabric, b. transferring each sliver from a separate sliver source to a common sliver feeding device, c. individually controlling the transfer of each sliver to the sliver feeding device, by means of an angularly and axially adjustable cam, to permit the device to feed the fibers of each sliver to selected needles for incorporation into selected wales and selected courses of the fabric by i. transferring each sliver to the sliver feeding device for plural intervals of time, each interval of selected duration, to incorporate the fibers of each sliver into selected courses of the fabric and ii. advancing the points in time when the time intervals of sliver transfer commence and cease, and retarding the points in time when the time intervals of sliver transfer commence and cease, to incorporate the sliver fibers into selected wales of the selected courses of the fabric.

5. A sliver feeding device for a high pile fabric knitting machine, said device having a main cylinder, at least two assemblies of sliver feed rolls, drive means for rotating each assembly of feed rolls, including an electric clutch for each feed roll assembly, and sliver feed control means for rotating the feed rolls during selected time intervals to deliver sliver to the main cylinder, said control means including a separate timing control device connected operatively to each assembly of feed rolls, each timing control device including a. an electric switch connected to the feed roll clutch, b. a rotatable timing cam operable to actuate the switch during selected intervals of time, to energize the clutch and rotate the feed rolls, said cam being of generally cylindrical formation and being provided with a raised area adapted to contact the switch, c. drive means for the cam to rotate the cam continuously, d. first control means for adjusting the cam axially relative to the switch to vary selectively the duration of the time intervals during which the cam actuates the switch and e. second control means for adjusting the cam angularly, during its rotation, relative to the switch, to vary selectively the points in time when the time intervals commence and cease during which the rotating cam actuates the switch.

6. A sliver feeding device according to claim 5, wherein the knitting machine includes a rotatable ring gear, and wherein a. the drive means for rotating the cam is connected to the ring gear and b. the second control means includes i. a reversible electric motor, ii. a pair of switches for controlling the reversible motor and iii. switch actuating means operable by the motor to actuate the switches in alternation, to reverse periodically the direction of rotation of the motor.

7. A sliver feeding device according to claim 6, wherein a. the second control means includes adjustment means for displacing the rotatable cam angularly relative to its axis of rotation and b. drive means connecting the cam adjustment means to the reversible electric motor, c. said drive means including reversing means to reverse periodically the angular displacement of the cam in response to the periodic reversal of the direction of rotation of the motor.

8. A sliver feeding device according to claim 6, wherein a. the cam drive means of each timing control device is connected to the ring gear and b. each second control means of each timing control device is driven by a common reversible electric motor and c. each timing control device includes separate and independent control means for its rotatable cam whereby the rotatable cam i. is independently operable to actuate its switch for intervals of time of selected duration and ii. is independently operable to vary the points in time when said time intervals commence and cease, iii. whereby each assembly of sliver feed rolls delivers sliver to the main cylinder during independently selected time intervals to produce patterned high pile fabric.

9. A method of feeding a plurality of separate slivers to the needles of a high pile fabric knitting machine at a single sliver feeding station to produce patterned high pile fabrics having selectively variable course-wise and wale-wise extending designs, comprising the steps of a. transferring each sliver from a separate sliver source to a common sliver feeding device, b. operating the sliver feeding device to feed sliver fibers to the needles of the knitting machine and c. individually controlling the transfer of each sliver to the sliver feedin device, by means of an angularly and axially adjustable cam, to feed the fibers of each sliver to selected needles for incorporation into selected wales of selected courses of the fabric by i. transferring each sliver to the sliver feeding device for plural time intervals each of selected duration, to provide a wale-wise extending pattern in the fabric, and ii. varying the points in time when at least some of the time intervals of sliver transfer commence and cease, to select for each fabric course in the pattern the number of needles to which the fibers of the sliver are fed.

10. The method of claim 9, further including the steps of advancing the point in time when the time intervals of sliver transfer commence and cease, and retarding the points in time when the time intervals of sliver transfer commence and cease, said steps occurring in alternation, to incorporate the sliver fibers into selected wales of the fabric.

11. The method of claim 9, wherein separate slivers are of contrasting colors.

12. The method of claim 9, wherein separate slivers are of different weights.

* * * * *